United States Patent [19]

Niyama et al.

[11] Patent Number: 4,561,488

[45] Date of Patent: Dec. 31, 1985

[54] METHOD OF AND APPARATUS FOR CONTINUOUSLY CASTING METAL STRIP

[75] Inventors: Eisuke Niyama, Katsuta; Tatsushi Aizawa, Ibaraki, both of Japan

[73] Assignee: Hitachi, Ltd., Tokyo, Japan

[21] Appl. No.: 467,809

[22] Filed: Feb. 18, 1983

[30] Foreign Application Priority Data

Feb. 19, 1982 [JP] Japan ..... 57-24487

[51] Int. Cl.[4] ..... B22D 11/06

[52] U.S. Cl. ..... 164/463; 164/429; 164/423; 164/479

[58] Field of Search ..... 164/463, 427, 429, 423, 164/479, 480

[56] References Cited

U.S. PATENT DOCUMENTS

| | | | |
|---|---|---|---|
| 2,745,151 | 5/1956 | Brennan | 164/429 |
| 2,878,537 | 3/1959 | Brennan | 164/429 |
| 2,962,777 | 12/1960 | Harrison | 164/479 |
| 3,208,112 | 9/1965 | Scribner | 164/480 |
| 3,338,295 | 8/1967 | Scribner | 164/429 |
| 3,381,739 | 5/1968 | Hart | 164/479 |
| 3,498,362 | 3/1970 | Lewis | 164/480 |
| 3,587,717 | 6/1971 | Yamauchi | 164/429 |
| 3,703,204 | 11/1972 | Brownstein | 164/429 |
| 3,773,102 | 11/1973 | Gerding | 164/429 |
| 3,863,700 | 2/1975 | Bedell et al. | 164/463 |
| 3,881,541 | 5/1975 | Bedell | 164/423 |
| 3,971,123 | 7/1976 | Olsson | 164/429 |
| 3,976,117 | 8/1976 | Olsson | 164/429 |
| 4,016,925 | 4/1977 | Sumida | 164/429 |
| 4,170,257 | 10/1979 | Pond, Sr. et al. | 164/463 |
| 4,326,579 | 4/1982 | Pond, Sr. et al. | 164/423 |

FOREIGN PATENT DOCUMENTS

| | | | |
|---|---|---|---|
| 0040072 | 11/1981 | European Pat. Off. | 164/463 |
| 0001546 | 1/1982 | Japan | 164/463 |
| 0804188 | 2/1981 | U.S.S.R. | 164/423 |

*Primary Examiner*—Kuang Y. Lin
*Assistant Examiner*—Kurt Rowan
*Attorney, Agent, or Firm*—Antonelli, Terry & Wands

[57] ABSTRACT

A method and an apparatus for continuously casting a metal strip are disclosed. In the invention, a molten metal is supplied, by a forcible circulation, into a casting cavity defined between an outer peripheral surface of rotating cooled casting roll and an inner peripheral surface having a substantially U-shaped cross-section of a refractory inner vessel disposed to oppose to said outer peripheral surface with a predetermined gap left therebetween. The molten metal is supplied in such a manner that it flows in the same direction as the direction of rotation of said cooled casting roll so that the molten metal contacts only with the outer peripheral surface of the cooled casting roll over a predetermined circumferential length. As a result, the molten metal is solidified on the outer peripheral surface of the cooled casting roll to form a metal strip. Then, the metal strip is pulled upwardly while being separated from the outer peripheral surface of the cooled casting roll after the metal strip has come out of contact with the molten metal.

13 Claims, 10 Drawing Figures

METHOD OF AND APPARATUS FOR CONTINUOUSLY CASTING METAL STRIP

BACKGROUND OF THE INVENTION

The present invention relates to a method of and apparatus for continuously casting a metal strip and, more particularly, to a continuous casting method and apparatus in which a metal strip is produced by making a molten metal contact with an outer peripheral surface of a rotating cooled casting roll to solidify the molten metal in the form of a solidified metal strip on the outer peripheral surface of the cooled casting roll, and then pulling the solidified metal strip upwardly while separating the same from the outer peripheral surface of the cooled casting roll.

Continuous casting methods of the kind stated above are disclosed, for example, in the specification of U.S. Pat. No. 3,587,708, specification of German Pat. No. 2,234,699 and also in "Handbook on Continuous Casting" by E. Herrmann, Aluminum-Verlag Dusseldorf, 1980, pp 85-93.

A method so-called "Melt Extraction Solidification Method" has been known as a technic for continuously casting a metal strip at a high speed in the manner e plained above, by pulling and separating metal strip solidified at its one side from the rotating cooled casting roll. This known method will be explained hereinunder with specific reference to FIG. 1. A cooled casting roll 3 is partially immersed in the molten metal contained in a refractory vessel 1 and is rotated in the direction of an arrow C, so that a solidified metal strip 4 is formed on the peripheral surface of the cooled casting roll. The solidified metal strip is pulled in the direction of an arrow D in synchronization with the rotation of the cooled casting roll. A roll 5 and a knife 6 are used in combination for the control of contact and separation of the solidified strip with and from the cooled casting roll 3. This known method offers various advantages. For instance, a high-speed casting is attainable because there is no friction between the cooled casting roll 3 and the solidified metal strip 4. In addition, this method is suited to the production of thin metal strip because the solidification is made by cooling from one side. Furthermore, it is to be noted that a smooth casting surface of cast strip is obtainable particularly at the side thereof contacted with the outer peripheral surface of the cooled casting roll, because the outer peripheral surface is gently and smoothly brought into contact with the molten metal.

This known method, however, suffers from the following disadvantages. Namely, for the first point, the yield or rate of production of the metal strip is limited because the circumferential length over which the cooled casting roll 3 contacts the molten metal, i.e. the length of an arc between the points A and B shown in FIG. 1 is small and thus an amount of molten metal solidified per unit time is small. This is attributable to the facts that the level of the molten metal surface 8 cannot be raised above the level of the rotating shaft 7 of cooled casting roll 3 and that the area of contact between the side walls of the cooled casting roll 3 and the molten metal 2 is increased as the level of the molten metal surface 8 is raised to unnecessarily increase the heat input to the cooled casting roll 3.

For the second point, it is to be pointed out that the thickness of the solidified strip 4 tends to become non-uniform. This is atributable to the fact that a slight fluctuation in the level of molten metal surface 8 exerts an influence upon the contact length AB thereby changing the time length of contact between the molten metal 2 and the cooled casting roll 3.

For the third point, it is difficult to obtain the required cross-sectional shape of the solidified strip. Namely, as shown in FIG. 2, substantially L-shaped projections or lugs 9 tend to be formed to project from both side edges of the solidified metal strip 4 in the breadthwise direction of the solidified strip 4, unless a suitable measure is taken on the cooled casting roll 3 for preventing the molten metal from solidifying on the side surfaces of the roll 3. These lugs 9 seriously deteriorate the cross-sectional shape of the solidified strip. As one of the measures for preventing the molten metal from solidifying on the side surfaces of the cooled casting roll, it has been proposed to provide heat insulating members on the side surfaces of the cooled casting roll 3. This solution, however, imposes another problem that the thickness of the solidified strip 4 is reduced undesirably along both side edges thereof due to insufficient cooling at both side edges of the cooled casting roll 3, although it ensures a substantially uniform breadth of the solidified strip 4. In order to overcome this problem, it has been proposed to dispose heat insulating guide members along both side surfaces of the cooled casting roll 3. In this case, however, it is necessary to provide a gap between each guide member and side surface of the cooled casting roll 3, in order to avoid friction therebetween. It is quite difficult and almost impossible practically to provide such a gap between the heat insulating guide members and the side surfaces of the cooled casting roll 3 in such a manner as to prevent the molten metal from solidifying on the side surfaces of the cooled casting roll 3 in spite of the presence of the gap.

SUMMARY OF THE INVENTION

Accordingly, it is a first object of the invention to provide a continuous casting method and apparatus for producing a metal strip, improved to ensure a large and constant circumferential length of contact between the outer peripheral surface of a cooled casting roll and a molten metal while avoiding the undesirable heating of side surfaces of the cooled casting roll so as to make it possible to produce at a high productivity a sound metal strip having high uniformity in the longitudinal direction and having no internal defects, thereby to overcome the above-described problems of the prior art.

A second object of the invention is to provide a continuous casting method and apparatus for producing a metal strip, improved to ensure a large and constant circumferential length of contact between the outer peripheral surface of a cooled casting roll and a molten metal while avoiding the undesirable heating of side surfaces of the cooled casting roll so as to make it possible to produce at a high productivity a sound metal strip having high uniformity in thickness both in the longitudinal and breadthwise directions and having no internal defects, thereby to overcome the above-described problems of the prior art.

The most remarkable feature of the invention resides in a point that the cooled casting roll is not at all immersed in the molten metal, unlike the known method explained hereinbefore. More specifically, according to the invention, the molten metal is circulated by an external force in such a manner as to flow through a casting cavity of a substantially T-shaped cross-section defined between the outer peripheral surface of the cooled casting roll and the inner peripheral surface having a substantially U-shaped cross-section of an inner refractory vessel. A part of the circulated molten metal comes out through an outlet of the inner vessel and is fed back into the bath of the molten metal contained in an outer refractory vessel. Further, in order to obtain a solidified strip having uniform thickness in the breadthwise direction, another part of the circulated molten metal is caused to overflow laterally (i.e. in the direction perpendicular to the direction of rotation of the cooled casting roll) through the lateral gaps formed between the outer peripheral surface of the cooled casting roll and both side edge portions of the aforementioned inner peripheral surface of inner refractory vessel and is fed back into the bath of the molten metal contained in the outer refractory vessel. Meanwhile, still another part of the circulated molten metal solidifies on the outer peripheral surface of the cooled casting roll to form a solidified metal strip, the thickness of which is progressively increased with the rotation of the cooled casting roll. Thereafter, the solidified metal strip is peeled off or separated from the outer peripheral surface of the cooled casting roll and is pulled and takenup upwardly. In order to make up for the consumption of the molten metal, i.e. the molten metal taken out as the solidified metal strip, fresh molten metal is always supplied through an inlet nozzle formed in the outer vessel.

The molten metal is supplied and flows down from a level above the point at which the molten metal starts to solidify on the outer peripheral surface of the cooled casting roll rotating at a constant speed. An electromagnetic pump is preferably used as means for circulating the molten metal.

DESCRIPTION OF THE PREFERRED EMBODIMENTS

Figure 1:
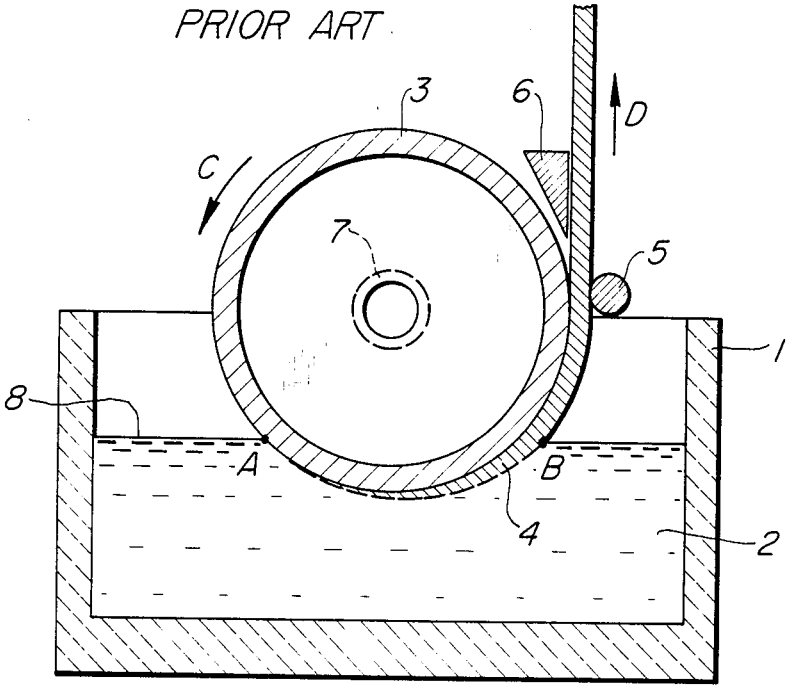
FIG. 1 PRIOR ART
FIG. 1 is a sectional side elevational view of a known apparatus for continuously casting metal strip.
Figure 2:
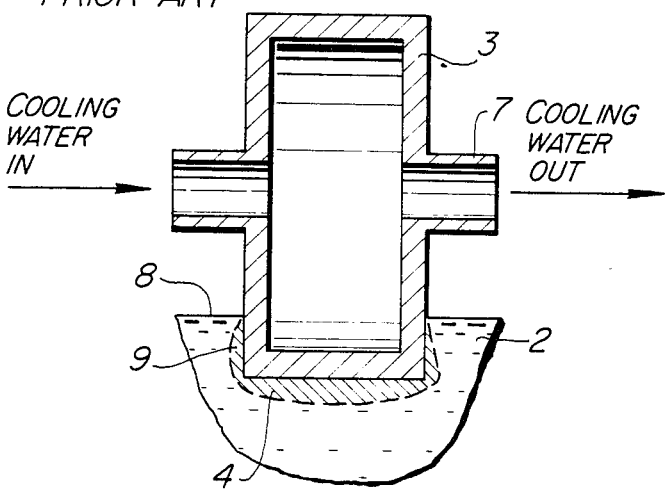
FIG. 2 PRIOR ART
FIG. 2 is a sectional view of an essential part of the apparatus shown in FIG. 1, taken in the breadthwise direction of a cooled casting roll.
Figure 3:
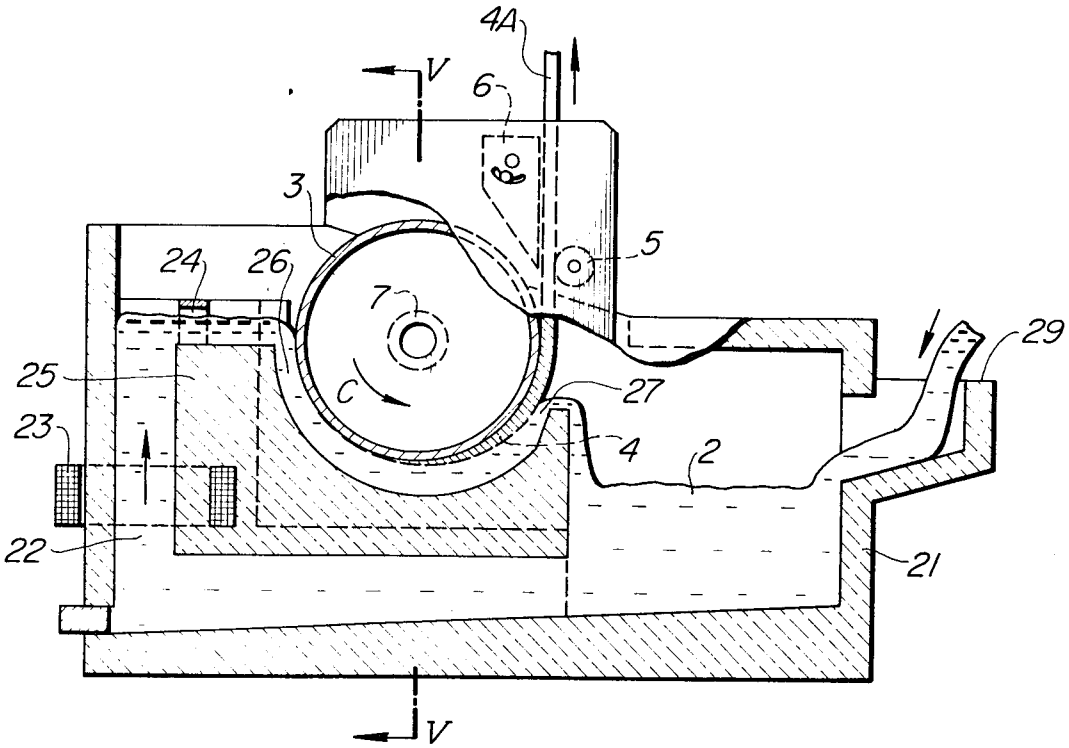
FIG. 3 is a sectional side elevational view of an apparatus for continuously casting a metal strip in accordance with a first embodiment of the invention.
Figure 4:
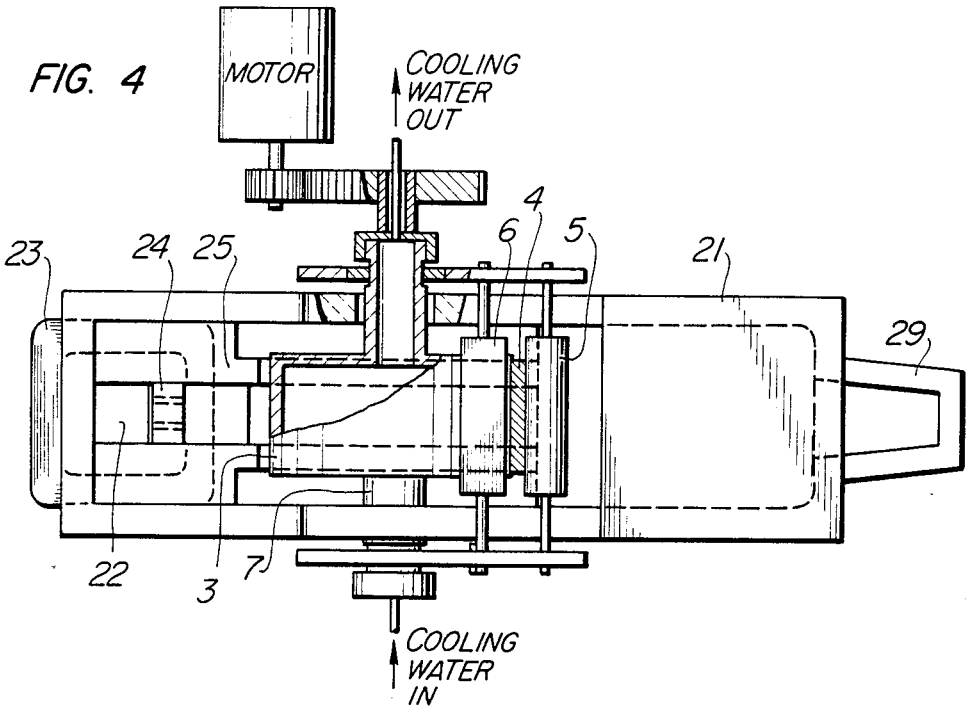
FIG. 4 is a plan view of the apparatus shown in FIG. 3.
Figure 5:
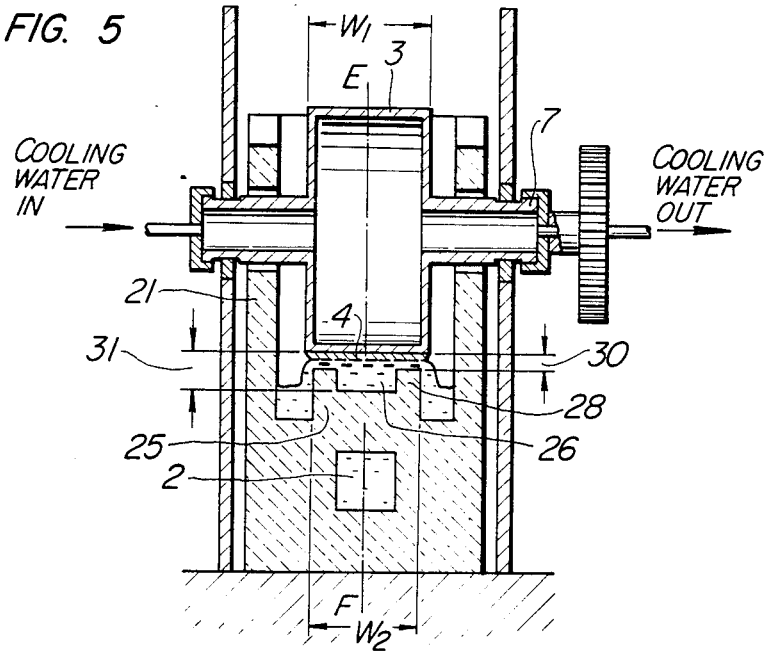
FIG. 5 is a vertical sectional view of the apparatus shown in FIG. 3 taken along the line V—V of FIG. 3.

The invention will be described in detail hereinunder with reference to the accompanying drawings. FIGS. 3 and 4 are a sectional side elevational view and a plan view of the apparatus for continuously casting a metal strip in accordance with a first embodiment of the invention, while FIG. 5 is a sectional view taken along the line V—V of FIG. 3. In these Figures, the same reference numerals are used to denote the same parts or members as those in FIG. 1.

A cooled casting roll 3 is rotated at a constant speed in the direction of an arrow C. A casting cavity 26 of a substantially T-shaped cross-section is defined between the outer peripheral surface of the cooled casting roll 3 and the inner peripheral surface having a substantially U-shaped cross-section of a refractory inner vessel 25. The molten metal 2 is forcibly supplied by the action of an electromagnetic pump 23 to flow upwardly through a passage 22 into the casting cavity 26 after passing through a strainer 24. The rotating speed of the cooled casting roll 3 is maintained below 120 rpm for preventing the molten metal from forming a turbulent flow in the casting cavity 26 and from flying off, and over 1 rpm for preventing the outer peripheral surface of the cooled casting roll 3 from being overheated. It is necessary that the supply of the molten metal be made at a level above the point at which the molten metal starts to solidify on the outer peripheral surface of the cooled casting roll 3. In addition, it is necessary that the molten metal be supplied at a level same as or lower than that of the rotating shaft 7 in order to apply the molten metal onto the outer peripheral surface of the cooled casting roll 3 from below. If the molten metal were supplied at a level above that of the rotating shaft 7, the molten metal would become stuck on the side surfaces of the cooled casting roll 3, and this must be avoided. The major aim of the strainer 24 is to stabilize the flow of the molten metal to ensure a constant and steady state contact between the cooled casting roll 3 and the molten metal 2, but the strainer 24 is useful also for cleaning the molten metal provided that the mesh of the strainer screen is sufficiently fine. Most of the molten metal forcibly circulated by the action of the electromagnetic pump 23 flows down in the direction of rotation of the cooled casting roll along the latter through the casting cavity 26 of substantially T-shaped cross-section and out through an outlet 27. Further, in order to obtain a solidified strip 4 having uniform thickness in the breadthwise direction, a part of the molten metal has to overflow laterally (i.e. in the direction perpendicular to the direction C of rotation of the cooled casting roll) through lateral gaps 30 as shown in FIG. 5. Meanwhile, the outer peripheral surface of the cooled casting roll 3 is held in contact with the molten metal to solidify the molten metal thereon to form a solidified metal strip, the thickness of which is progressively increased with the rotation of the cooled casting roll. The solidified strip 4 which has passed over the outlet 27 and, hence, come out of contact with the molten metal is peeled off or separated from the cooled casting roll 3 by the cooperation between the roll 5 and the knife 6, and is pulled upwardly as a metal strip 4A. As shown in Fig. 5, both side edge portions 28 of the inner vessel 25 are made higher than the central portion of the same so that the lateral gaps 30 formed between the upper ends of the side edge portions 28 and the outer peripheral surface of the cooled casting roll 3 are made smaller than the gap 31 of the central portion. As the solidified metal strip 4A is formed and pulled out continuously in a manner explained above, the molten metal 2 contained in the outer refractory vessel 21 is gradually consumed. To make up for this consumption of the molten metal, fresh molten metal is always supplied through an inlet nozzle 29.

In the continuously casting apparatus of this embodiment, the length of the region over which the molten metal 2 contacts with the outer peripheral surface of the cooled casting roll 3 is limited by the circumferential length of the inner peripheral surface of the inner vessel 25, and is independent of the amount of the molten metal 2 contained in the refractory outer vessel 21. Since the thickness of the solidified strip 4 is ruled mainly by the time length of contact between the outer peripheral surface of the cooled casting roll 3 and the molten metal 2, it is possible to ensure a constant thickness of the solidified metal strip by maintaining a constant rotating speed of the cooled casting roll. For this reason, it becomes possible to eliminate the necessity for the precise control of the amount of molten metal which is indispensable in the known method explained hereinbefore and, therefore, the fluctuation of thickness in the longitudinal direction of the metal strip 4A can be suppressed advantageously.

As will be seen from FIG. 3, the circumferential length of contact between the molten metal 2 and the outer peripheral surface of the cooled casting roll 3 does not depend on the level of the molten metal in the outer vessel 21 nor on the position of rotating shaft 7. It is, therefore, possible to obtain a circumferential length of contact greater than the circumferential length AB of contact obtained in the known apparatus shown in FIG. 1 and, hence, a greater productivity than that attained by the known apparatus.

In addition, since the breadth of the solidified strip 4 is ruled by the axial breadth of the cooled casting roll 3, it is possible to obtain a solidified strip having a precise breadth. Moreover, since the cooled casting roll 3 is not immersed in the molten metal 2 unlike the known apparatus shown in Fig. 1, the undesirable heating of the side surfaces of the cooled casting roll 3 is prevented to avoid breadthwise thickness variation of the solidified strip 4. In this embodiment, as will be seen from FIG. 5, the breadth $W_1$ of the cooled casting roll 3 is somewhat greater than the breadth $W_2$ of the inner vessel 25. In addition, the cooled casting roll 3 and the inner vessel 25 are so arranged that their central axes E and F coincide with each other. Generally speaking, the breadth of a groove defined between both side edge portions 28 is made equal to or smaller than the breadth $W_1$ of the cooled casting roll 3 in order to maintain a positive pressure in the molten metal contained in the groove. Further, in general, the breadth $W_2$ of the inner vessel 25 is made smaller than the breadth $W_1$ of the cooled casting roll 3 in order to obtain a solidified metal strip 4 having uniform thickness in its breadthwise direction.

In order to produce a sound metal strip having uniform thickness both in longitudinal and breadthwise directions with the apparatus shown in FIGS. 3 to 5, it is necessary not only that the casting cavity 26 between the outer peripheral surface of the cooled casting roll 3 and the inner peripheral surface of the inner vessel 25 is always filled with the molten metal 2 but also that the molten metal is continuously and steadily circulated forcibly by the electromagnetic pump 23 at such a flow rate that the molten metal always overflows laterally through the lateral gaps 30. To this end, the flow rate of molten metal supplied into the casting cavity 26 should be balanced with the sum of the amount of the molten metal carried away as the solidified strip, the amount of the molten metal flowing out from the outlet 27 and the amount of the molten metal overflowing through the lateral gaps 30. The lateral gap 30 for the overflow is preferably made as small as possible but has to be large enough to prevent the solidified strip from contacting the upper surfaces of the side edge portions 28 of the inner vessel 25. Practically, the size of the lateral gap 30 is determined to be about 2 to 3 times as large as the thickness of the solidified strip 4. Incidentally, in the embodiment shown in FIG. 5 although the side edge portions 28 are made integral with the body of the inner vessel 25, it is also possible to construct the side edge portions 28 as members separate from the body of the inner vessel 25 and then attach them to the latter so as to be vertically movable thereby to adjust the size of the lateral gap 30. In order to ensure a stable and steady flow of the molten metal, the gap 31 is preferably made large. When the gap 31 is too small, it is impossible to obtain the flow rate of molten metal sufficient for ensuring, in the downstream side, the amount of the molten metal carried away as the solidified strip and the amount of the molten metal overflowing through the lateral gap 30. To sum up, the requirement for the gap 31 is to maintain a positive pressure in the flow of molten metal in the casting cavity 26. Practically, the size of the casting cavity 26 is selected firstly by means of a water model and finally through an experiment conducted for an actual apparatus.

The surface of the metal strip produced by the apparatus shown in FIGS. 3 to 5 exhibited a high smoothness and an attractive appearance, especially at the side contacted with the cooled casting roll. The fluctuation in breadth and thickness was remarkedly reduced as compared with the prior art, which in turn contributed to an increase in the yield in the subsequent step.

Figure 6:
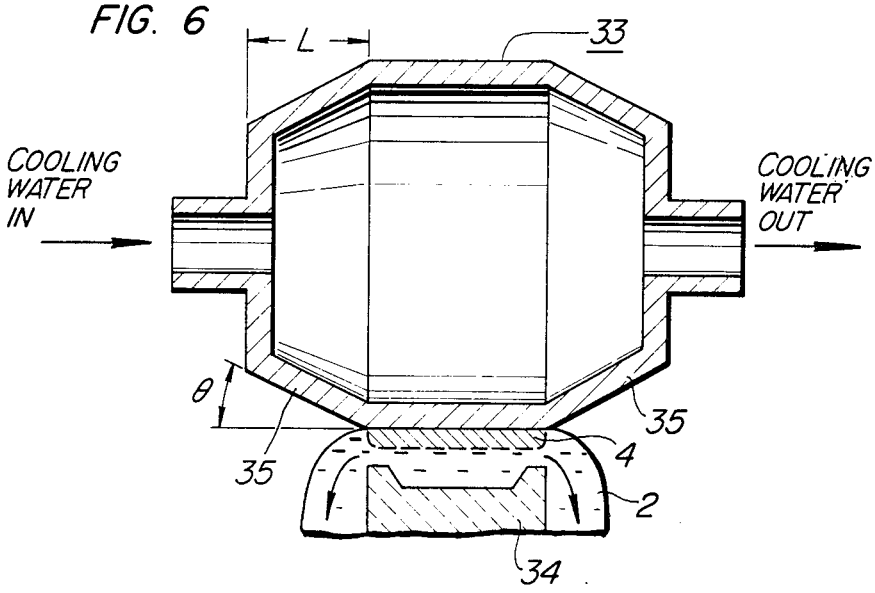
FIG. 6 is a sectional view of an essential part of the apparatus for continuously casting a metal strip in accordance with a second embodiment of the invention, taken in the breadthwise direction of the cooled casting roll.

FIG. 6 schematically shows in section a cooled casting roll 33 and a refractory inner vessel 34 in the continuously casting apparatus in accordance with a second embodiment of the invention. In this embodiment, the cooled casting roll 33 is provided at both its axial ends with frusto-conical protruded portions 35. These protruded portions impart an additional cooling effect to increase the rate of extraction of heat to the cooled casting roll 33 at both side edges of the solidified strip 4, so that the thickness of the strip is more uniformized at both side edge portions of the solidified strip. Each protruded portion 35 has a length L of 2–10 times as large as thickness of the solidified strip 4 to be obtained in order to give a sufficient cooling effect to the cooled casting roll 33, and has an angle $\theta$ which is smaller than 45 degrees. Other constructions are substantially identical to those of the first embodiment.

Figure 7:
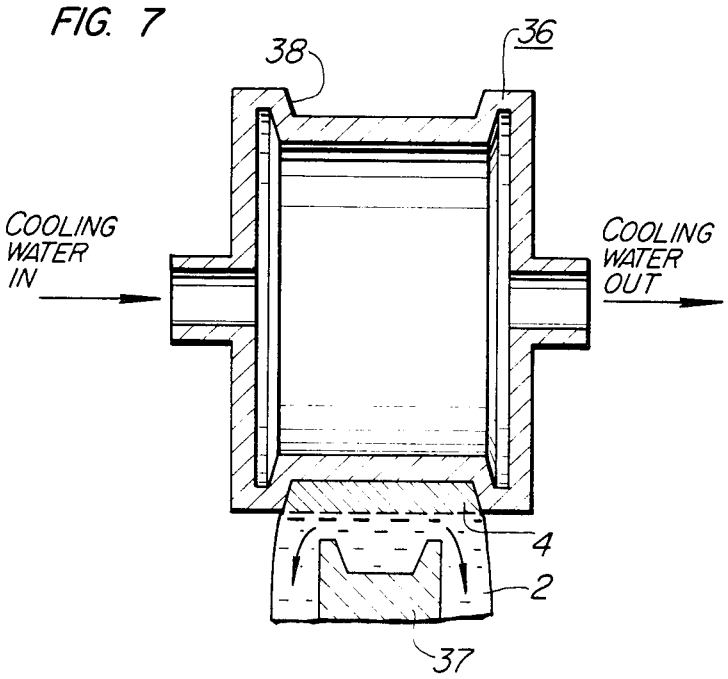
FIG. 7 is a sectional view an essential part of the apparatus for continuously casting a metal strip in accordance with a third embodiment of the invention, taken in the breadthwise direction of the cooled casting roll.

FIG. 7 is a sectional view schematically showing the cooled casting roll 36 and the refractory inner vessel 37 in the continuously casting apparatus in accordance with a third embodiment of the invention. In this embodiment, a groove 38 is formed in the outer peripheral surface of the cooled casting roll 36 so that the shape and thickness of the solidified strip 4 are further controlled and uniformized at both side edges of the strip by the walls of the groove 38. In addition, the breadth and the thickness of the solidified strip 4 are further uniformized due to the fact that the stable heat-extraction balance is ensured. Other constructions are substantially identical to those of the first embodiment.

Figure 8:
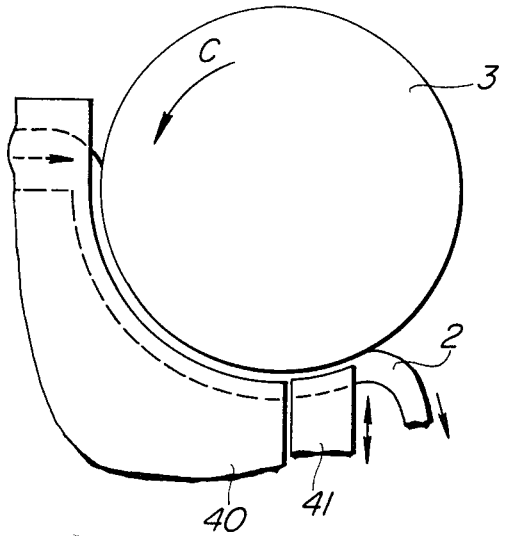
FIG. 8 is a side elevational view of an essential part of the apparatus for continuously casting a metal strip in accordance with a fourth embodiment of the invention.

FIG. 8 is a schematic side elevational view of the cooled casting roll 3 and the refractory inner vessel 40 of the continuously casting apparatus in accordance with a fourth embodiment of the invention. In this embodiment, a movable outlet guide 41 is attached to the refractory inner vessel 40. The arrangement is such that the circumferential length of contact between the molten metal 2 and the outer peripheral surface of the cooled casting roll 3 is adjusted to permit the adjustment of thickness of the solidified strip. Similar effect is achieveable in this embodiment by arranging such that the position of the rotating shaft of the cooled casting roll 3 is movable and adjustable while the inner vessel 40 and the guide 41 are held stationary. Other constructions are substantially identical to those of the first embodiment.

Figure 9:
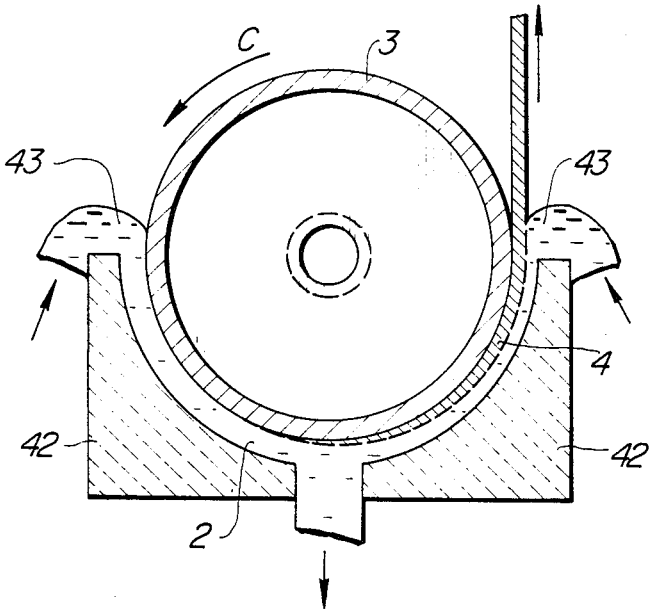
FIG. 9 is a sectional side elevational view of an essential part of the apparatus for continuously casting a metal strip in accordance with a fifth embodiment of the invention.

FIG. 9 is a sectional view of the cooled casting roll 3 and the refractory inner vessel of the continuously casting apparatus in accordance with a fifth embodiment of the invention. In this embodiment, a pair of inner vessels 42 are disposed to oppose each other so that the inlet 43 for the molten metal is formed not only at the upstream side but also at the downstream side of the cooled casting roll 3 as viewed in the direction C of rotation of the cooled casting roll 3. By so doing, it is possible to remarkably increase the circumferential length of contact between the outer peripheral surface of the cooled casting roll 3 and the molten metal 2, while completely avoiding the contact of the molten metal with the side surfaces of the cooled casting roll 3. According to this arrangement, it is possible to continuously cast comparatively thick metal strip at high speed. Other constructions are substantially identical to those in the first embodiment.

Figure 10:
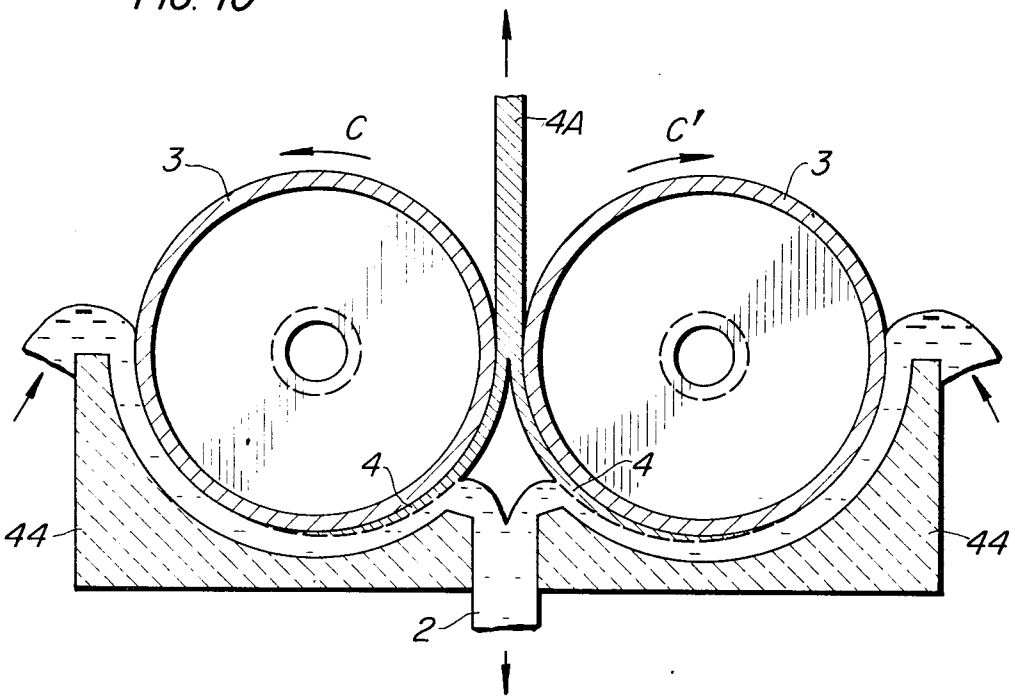
FIG. 10 is a sectional side elevational view of an essential part of the apparatus for continuously casting a metal strip in accordance with a sixth embodiment of the invention.

FIG. 10 is a sectional side elevational view of the cooled casting roll 3 and the refractory inner vessel of the continuously casting apparatus in accordance with a sixth embodiment of the invention. In this embodiment, two pairs of a combination of a cooled casting roll 3 and a refractory inner vessel 44 are arranged in a mirror image symmetry relationship to each other as illustrated. According to this arrangement, it is possible to continuously cast a metal strip of a thickness twice as large as that produced by the apparatus having a single cooled casting roll 3 at the same speed. In this case, the surfaces of the product strip are highly smooth because the solidified strip 4A is contacted at both its sides with respective cooled casting rolls. Other constructions are substantially identical to those of the first embodiment.

As has been described, according to the invention, there is provided a single-side contact type continuously casting method and apparatus for producing a metal strip by bringing a molten metal into contact with the outer peripheral surface of a rotating cooled casting roll, wherein the circumferential length of contact between the outer peripheral surface of the cooled casting roll and the molten metal is increased and the fluctuation in the contact length is substantially eliminated to make it possible to produce a metal strip of a uniform thickness and breadth. In addition, it is possible to obviate the lack of uniformity in the strip thickness caused by a thermal influence attributable to the contact of the molten metal with the side surfaces of the cooled casting roll. Furthermore, since the necessity for providing guides close to the side walls of the cooled casting roll is avoided, it is possible to avoid any friction which may otherwise be caused by the contact between the guides and the roll, as well as to prevent the molten metal from penetrating into the gaps between the guides and the side surfaces of the roll. The increased circumferential length of contact offers advantages such as an increase in the thickness of the solidified strip or an increase in the casting speed which is turn ensures a higher production speed. It is also possible to clean the molten metal while it flows through a flow passage, hence, to supply clean molten metal containing smaller amount of oxides into the casting cavity.

Although the invention has been described with reference to the specific embodiments, it is to be noted here that the described embodiments are not exclusive and various changes and modifications may be imparted thereto without departing from the scope of the invention which is limited solely by the appended claims.

What is claimed is:

1. A method of continuously casting a metal strip comprising: a first step of supplying a molten metal, by circulating said molten metal by an externally applied force, into a casting cavity defined between an outer peripheral surface of a rotating cooled casting roll and an inner peripheral surface having a substantially U-shaped cross-section of a refractory inner vessel disposed to oppose to said outer peripheral surface with a predetermined gap left therebetween, said molten metal being supplied in such a manner that it flows down in the same direction as the direction of rotation of said cooled casting roll, so that said molten metal contacts only with the outer peripheral surface of said cooled casting roll over a predetermined circumferential length while simultaneously causing a part of the circulated molten metal to overflow laterally through the lateral gaps formed between the side edge portions of said inner peripheral surface of said inner vessel and the outer peripheral surface of said cooled casting roll in the direction perpendicular to the direction of rotation of said cooled casting roll, thereby to solidify said molten metal on the outer peripheral surface of said cooled casting roll to form a metal strip; and a second step of pulling said metal strip upwardly while separating the same from the outer peripheral surface of said cooled casting roll after said metal strip has come out of contact with said molten metal.

2. A method of continuously casting a metal strip according to claim 1, wherein the size of said lateral gaps formed between said side edge portions of said inner peripheral surface of said inner vessel and the outer peripheral surface of said cooled casting roll is two or threee times as large as that of the thickness of the solidified strip.

3. An apparatus for continuously casting a metal strip comprising:

a cooled casting roll mounted rotatably without being immersed in a molten metal;

a molten metal guiding means for making a molten metal flow down in contact with an outer peripheral surface of said cooled casting roll, said means having an inner peripheral surface of a substantially U-shaped cross-section, when viewed in a plane parallel to a rotating shaft of said cooled casting roll, which opposes and cooperates with the outer peripheral surface of said cooled casting roll in defining therebetween a casting zone over a predetermined circumferential length along the outer peripheral surface of said cooled casting roll, both side edge portions of said inner peripheral surface, as viewed in said cross-section, defining a portion of said casting zone which is located within the breadth of said casting roll, said side edge portions being opposed to and spaced by a predetermined distance from the outer peripheral surface of said cooled casting roll so that a part of the molten metal can overflow laterally therebetween;

a molten metal circulation means for supplying said molten metal into said casting cavity by a forcible circulation; and pulling means for pulling the metal strip solidified on the outer peripheral surface of said cooled casting roll while separating the solidifed metal from said cooled casting roll after said solidified strip has come out of contact with said molten metal.

4. An apparatus for continuously casting a metal strip according to claim 3, wherein said cooled casting roll is provided at its both axial ends with frustoconical protruded portions.

5. An apparatus for continuously casting a metal strip according to claim 3, wherein a groove is formed in the outer peripheral surface of said cooled casting roll.

6. An apparatus for continuously casting a metal strip according to claim 3, wherein said molten metal guiding means includes a movable outlet guide attached thereto.

7. An apparatus for continuously casting a metal strip according to claim 3, wherein said molten metal guiding means are arranged in a pair so as to oppose to each other.

8. An apparatus for continuously casting a metal strip according to claim 3, wherein two pairs of a combination of said cooled casting roll and said molten metal guiding means are disposed in a mirror image symmetry relationship to each other.

9. An apparatus for continuously casting a metal strip according to claim 3, wherein said molten metal circulating means is an electromagnetic pump.

10. An apparatus for continuously casting a metal strip according to claim 3, wherein a strainer is disposed at the upstream side of said casting cavity as viewed in the flowing direction of molten metal.

11. A method of continuously casting a metal strip according to claim 2, wherein said molten metal is supplied to flow down from a level above the position at which said solidified strip starts to be formed.

12. A method of continously coating a metal strip according to claim 1, wherein said molten metal is supplied by a forced circulation with an electromagnetic pump.

13. A method of continuously coating a metal strip according to claim 1, wherein said cooled casting roll is rotated at a constant speed.

* * * * *